US006353212B1

(12) United States Patent
Smith

(10) Patent No.: US 6,353,212 B1
(45) Date of Patent: Mar. 5, 2002

(54) SNOW MELTING ATTACHMENT FOR A SNOW BLOWER

(76) Inventor: Robert Smith, 101 N. 13th St., Allentown, PA (US) 18102

( * ) Notice: Subject to any disclaimer, the term of this patent is extended or adjusted under 35 U.S.C. 154(b) by 0 days.

(21) Appl. No.: 09/939,042

(22) Filed: Aug. 24, 2001

(51) Int. Cl.[7] ..... H05B 3/06
(52) U.S. Cl. ..... 219/533; 37/226; 37/227
(58) Field of Search ..... 219/533, 201, 219/202; 37/219, 227, 228, 229, 230

(56) References Cited

U.S. PATENT DOCUMENTS

| | | | | | |
|---|---|---|---|---|---|
| 2,820,450 | A | | 1/1958 | Zimmerman | |
| 3,174,477 | A | | 3/1965 | Wilson | |
| 3,577,975 | A | * | 5/1971 | Farsbetter | 126/343.5 |
| 3,911,601 | A | * | 10/1975 | Maheau | 37/43 R |
| 4,353,176 | A | * | 10/1982 | Hess | 37/228 |
| D270,057 | S | | 8/1983 | Nakamura | |
| 4,409,957 | A | | 10/1983 | Muhammad | |
| 4,676,224 | A | * | 6/1987 | Ohno | 126/343.5 R |
| 4,785,561 | A | * | 11/1988 | Swanson | 37/197 |
| 5,235,762 | A | * | 8/1993 | Brady | 37/228 |
| 5,438,770 | A | * | 8/1995 | Miller | 37/227 |
| 5,588,231 | A | | 12/1996 | Mavrianos | |
| 5,867,926 | A | | 2/1999 | Schmitt | |
| 5,890,507 | A | * | 4/1999 | Hinsperger | 135/96 |
| 5,956,872 | A | * | 9/1999 | Mavrianos | 37/228 |
| 6,305,105 | B1 | * | 10/2001 | Lowman | 37/228 |

* cited by examiner

*Primary Examiner*—Teresa Walberg
*Assistant Examiner*—Vinod D Patel

(57) ABSTRACT

A snow melting attachment for a snow blower for preventing the building up of large snow piles includes a housing having a bottom wall and a peripheral wall. The peripheral wall has an upper edge defining an opening extending into the housing. The housing is mountable on the snow blower. A drainage pipe is fluidly coupled to the housing. A valve is in communication with the drainage pipe for selectively opening and closing the drainage pipe. A plurality of plates is mounted in the housing. Each of the plates has an upper side and a lower side. A plurality of heating elements is mounted in the housing. Each of the heating elements is positioned adjacent to one of the lower sides of the plates such that a plurality of heating elements is adjacent to each of the plates. The heating elements are each operationally coupled to a power supply.

11 Claims, 6 Drawing Sheets

SNOW MELTING ATTACHMENT FOR A SNOW BLOWER

BACKGROUND OF THE INVENTION

1. Field of the Invention

The present invention relates to snow melting devices and more particularly pertains to a new snow melting attachment for a snow blower for preventing the building up of large snow piles.

2. Description of the Prior Art

The use of snow melting devices is known in the prior art. More specifically, snow melting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,409,957; U.S. Pat. No. 5,867,926; U.S. Pat. No. 3,174,477; U.S. Pat. No. 2,820,450; U.S. Pat. No. 5,588,231; and U.S. Des. Pat. No. 270,057.

While these devices fulfill their respective, particular objectives and requirements, the aforementioned patents do not disclose a new snow melting attachment for a snow blower. The inventive device includes a housing having a bottom wall and a peripheral wall extending upwardly from the bottom wall. The peripheral wall has an upper edge defining an opening extending into the housing. The housing is mountable on a snow blower. A drainage pipe is fluidly coupled to the housing and is positioned generally adjacent to the bottom wall. A valve is in communication with the drainage pipe for selectively opening and closing the drainage pipe. A plurality of plates is mounted in the housing. Each of the plates has an upper side and a lower side with respect to the bottom wall of the housing. A plurality of heating elements is mounted in the housing. Each of the heating elements is positioned adjacent to one of the lower sides of the plates such that a plurality of heating elements is adjacent to each of the plates. The heating elements are each operationally coupled to a power supply.

In these respects, the snow melting attachment for a snow blower according to the present invention substantially departs from the conventional concepts and designs of the prior art, and in so doing provides an apparatus primarily developed for the purpose of preventing the building up of large snow piles.

SUMMARY OF THE INVENTION

In view of the foregoing disadvantages inherent in the known types of snow melting devices now present in the prior art, the present invention provides a new snow melting attachment for a snow blower construction wherein the same can be utilized for preventing the building up of large snow piles.

The general purpose of the present invention, which will be described subsequently in greater detail, is to provide a new snow melting attachment for a snow blower apparatus and method which has many of the advantages of the snow melting devices mentioned heretofore and many novel features that result in a new snow melting attachment for a snow blower which is not anticipated, rendered obvious, suggested, or even implied by any of the prior art snow melting devices, either alone or in any combination thereof.

To attain this, the present invention generally comprises a housing having a bottom wall and a peripheral wall extending upwardly from the bottom wall. The peripheral wall has an upper edge defining an opening extending into the housing. The housing is mountable on a snow blower. A drainage pipe is fluidly coupled to the housing and is positioned generally adjacent to the bottom wall. A valve is in communication with the drainage pipe for selectively opening and closing the drainage pipe. A plurality of plates is mounted in the housing. Each of the plates has an upper side and a lower side with respect to the bottom wall of the housing. A plurality of heating elements is mounted in the housing. Each of the heating elements is positioned adjacent to one of the lower sides of the plates such that a plurality of heating elements is adjacent to each of the plates. The heating elements are each operationally coupled to a power supply.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new snow melting attachment for a snow blower apparatus and method which has many of the advantages of the snow melting devices mentioned heretofore and many novel features that result in a new snow melting attachment for a snow blower which is not anticipated, rendered obvious, suggested, or even implied by any of the prior art snow melting devices, either alone or in any combination thereof.

It is another object of the present invention to provide a new snow melting attachment for a snow blower which may be easily and efficiently manufactured and marketed.

It is a further object of the present invention to provide a new snow melting attachment for a snow blower which is of a durable and reliable construction.

An even further object of the present invention is to provide a new snow melting attachment for a snow blower which is susceptible of a low cost of manufacture with regard to both materials and labor, and which accordingly is then susceptible of low prices of sale to the consuming public, thereby making such snow melting attachment for a snow blower economically available to the buying public.

Still yet another object of the present invention is to provide a new snow melting attachment for a snow blower which provides in the apparatuses and methods of the prior art some of the advantages thereof, while simultaneously overcoming some of the disadvantages normally associated therewith.

Still another object of the present invention is to provide a new snow melting attachment for a snow blower for preventing the building up of large snow piles.

Yet another object of the present invention is to provide a new snow melting attachment for a snow blower which includes a housing having a bottom wall and a peripheral wall extending upwardly from the bottom wall. The peripheral wall has an upper edge defining an opening extending into the housing. The housing is mountable on a snow blower. A drainage pipe is fluidly coupled to the housing and is positioned generally adjacent to the bottom wall. A valve is in communication with the drainage pipe for selectively opening and closing the drainage pipe. A plurality of plates is mounted in the housing. Each of the plates has an upper side and a lower side with respect to the bottom wall of the housing. A plurality of heating elements is mounted in the housing. Each of the heating elements is positioned adjacent to one of the lower sides of the plates such that a plurality of heating elements is adjacent to each of the plates. The heating elements are each operationally coupled to a power supply.

Still yet another object of the present invention is to provide a new snow melting attachment for a snow blower that may be retrofitted to existing snow blowers.

Even still another object of the present invention is to provide a new snow melting attachment for a snow blower that allows a user to melt snow instead of creating large snow piles which can cause winter kill to grass and which block viewing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
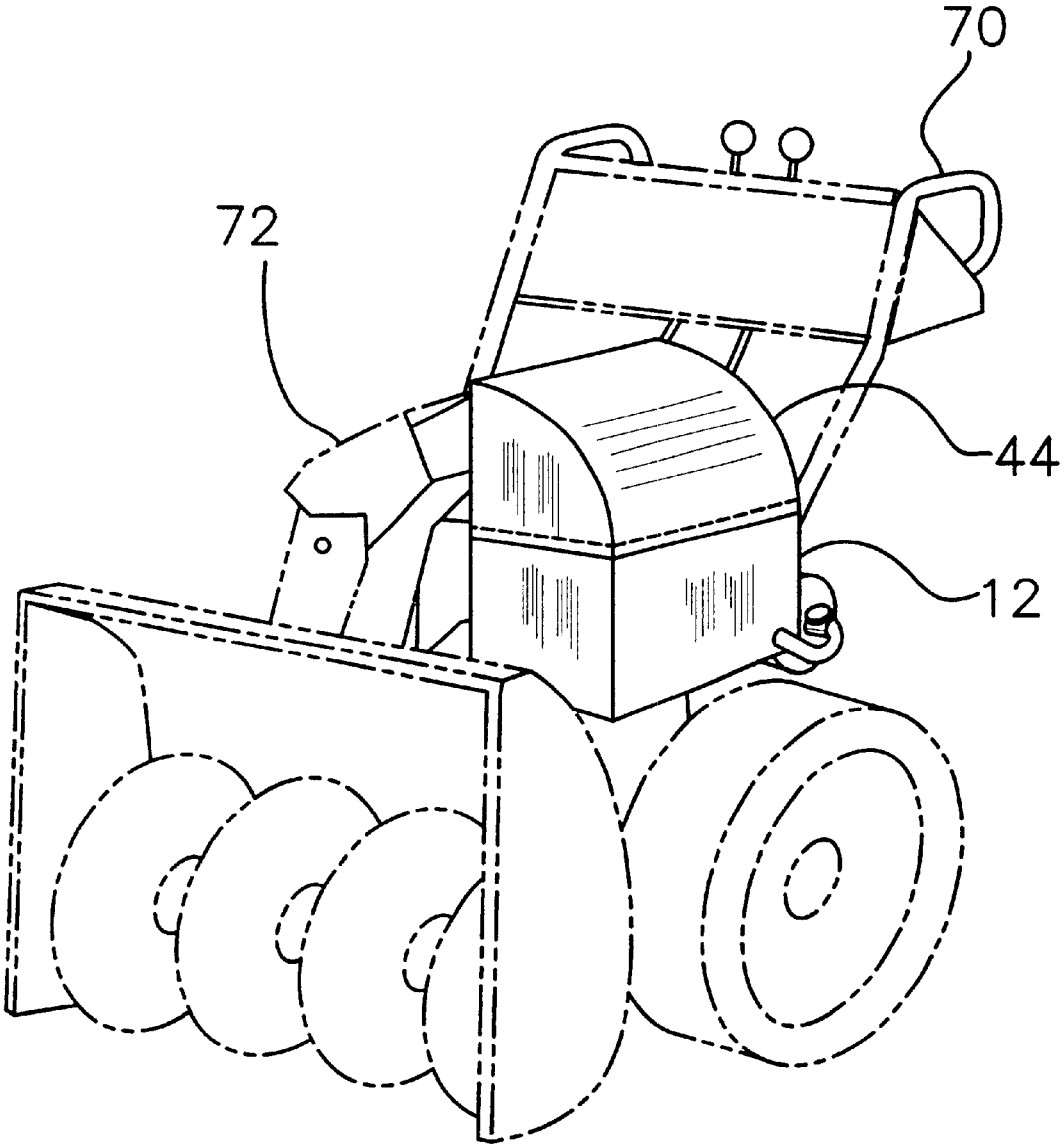
FIG. 1 is a schematic perspective view of a new snow melting attachment for a snow blower according to the present invention.
Figure 2:
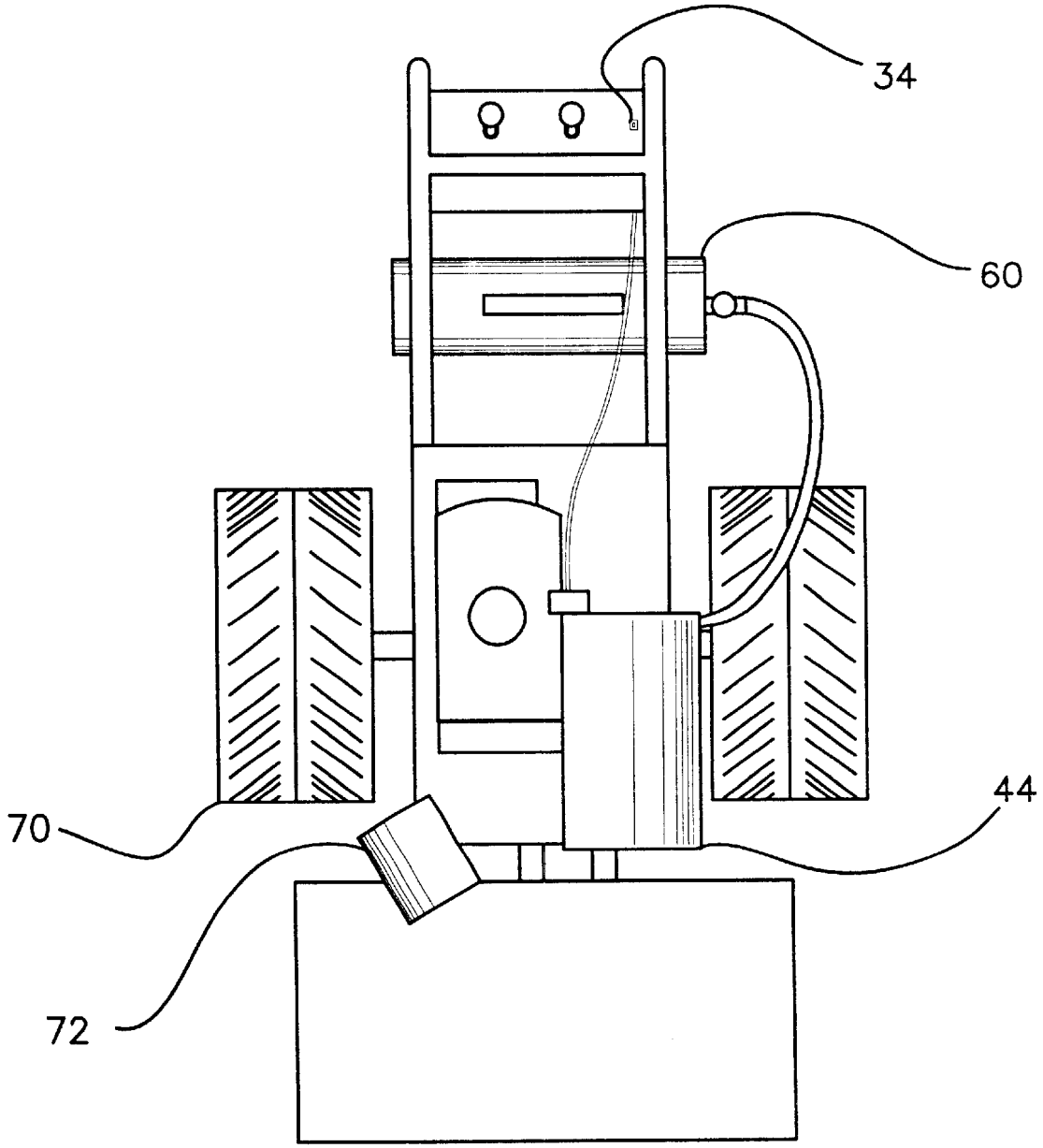
FIG. 2 is a schematic top view of the present invention.
Figure 3:
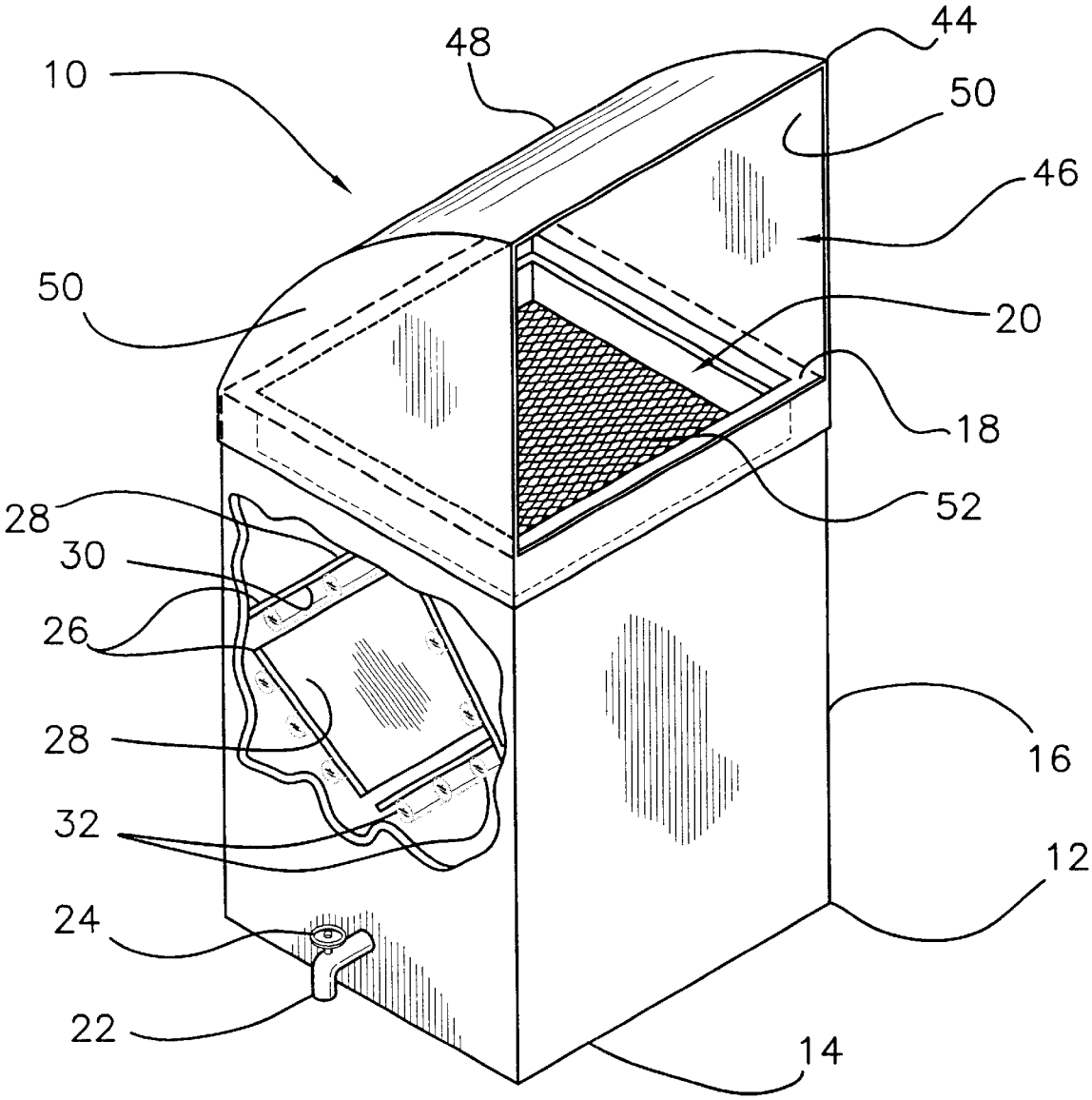
FIG. 3 is a schematic perspective view of the present invention.
Figure 4:
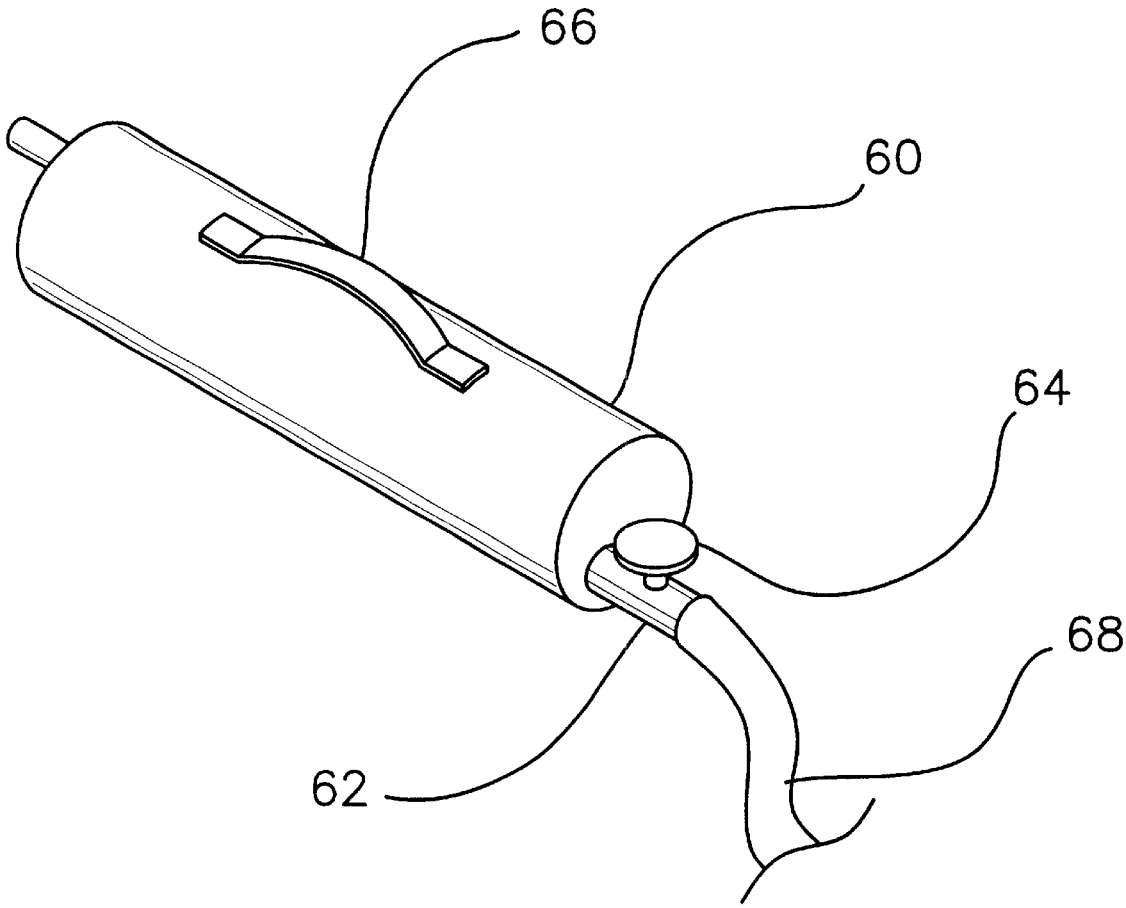
FIG. 4 is a schematic perspective view of the container of the present invention.
Figure 5:
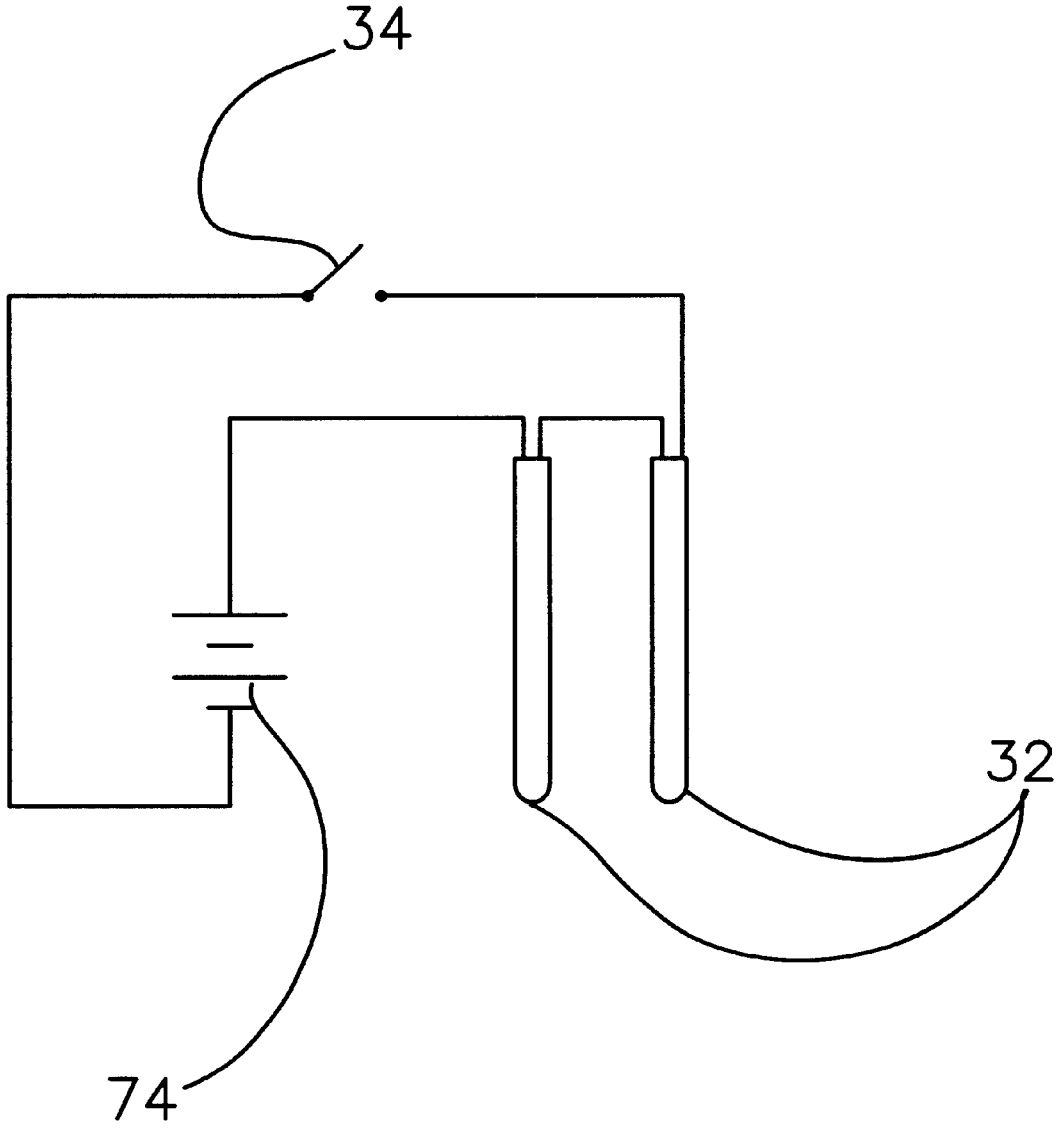
FIG. 5 is a schematic view of the present invention.
Figure 6:
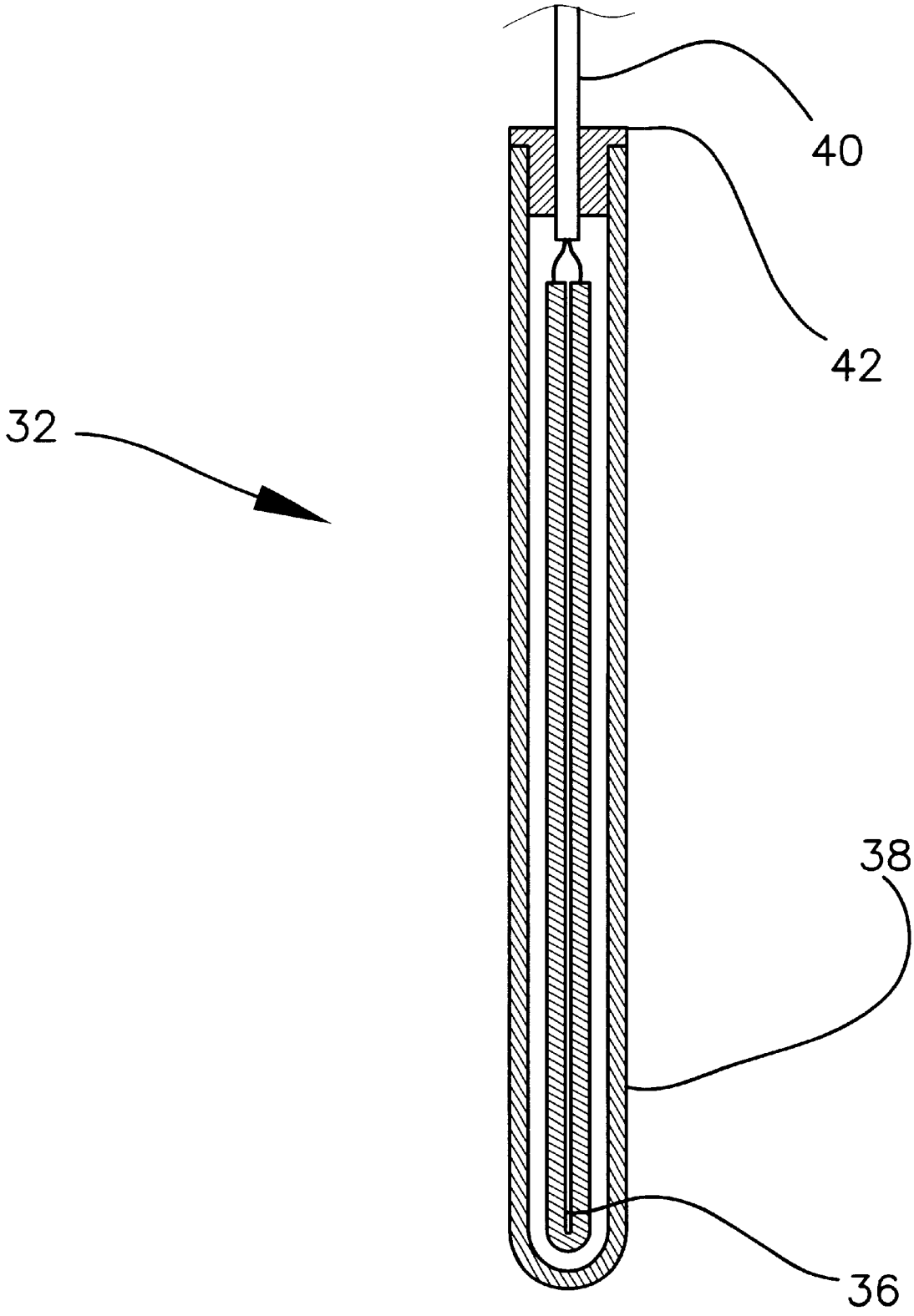
FIG. 6 is a schematic cross-sectional view of a heating element of the present invention.

With reference now to the drawings, and in particular to FIGS. 1 through 6 thereof, a new snow melting attachment for a snow blower embodying the principles and concepts of the present invention and generally designated by the reference numeral 10 will be described.

As best illustrated in FIGS. 1 through 6, the snow melting attachment 10 for a snow blower generally comprises a device 10 for removably mounting to a conventional snow blower 70. The snow blower 70 ideally has a movable thrower 72 for directing direction of snow is thrown. The snow blower 70 has a power supply 74. The device 10 includes a housing 12 having a bottom wall 14 and a peripheral wall 16 extending upwardly from the bottom wall 14. The peripheral wall 16 has an upper edge 18 defining an opening 20 extending into the housing 12. The bottom wall 14 has a generally rectangular shape. The housing 12 is mountable on the snow blower 70.

A drainage pipe 22 is fluidly coupled to the housing 12 and is positioned generally adjacent to the bottom wall 14. A valve 24 is in communication with the drainage pipe 22 for selectively opening and closing the drainage pipe 22.

Each of a plurality of plates 26 is mounted in the housing 12. Each of the plates 26 has an upper side 28 and a lower side 30 with respect to the bottom wall 14 of the housing 12. Each of the plates 26 is angled with respect to the bottom wall 14 at an angle generally between 30 degrees and 60 degrees.

A plurality of heating elements 32 is mounted in the housing 12. Each of the heating elements 32 is positioned adjacent to one of the lower sides 30 of the plates 26 such that a plurality of heating elements 32 is adjacent to each of the plates 26. Each of the heating elements 32 is operationally coupled to the power supply 74. An actuator 34 is operationally coupled to the heating elements 32 for selectively turning the heating elements 32 on or off. The heating elements 32 preferably comprise an electrical heated element 36 being covered by a protective covering 38. A power cable 40 extends through a seal 42 on the covering 38 to insulate the electrical heating element 36 from any water in the device 10.

A hood 44 is attached to the upper edge 18 of the peripheral wall 16. The hood 44 has an open vertical face 46, an arcuate upper wall 48 extending from a top side of the vertical face 46 to the peripheral wall 16, and a pair of side walls 50. The thrower 72 may be aimed toward the hood 44.

A screen 52 is attached to the upper edge 18 of the peripheral wall 16 and generally extends over the opening 20 in the housing 12. The screen 52 preferably comprises a metallic mesh material.

A container 60 has a receiving pipe 62 thereon which is in communication with the drainage pipe 22. The container 60 is removably mountable to the snow blower 70. A valve 64 is fluidly coupled to the receiving pipe for selectively opening and closing the receiving pipe. A handle 66 is mounted on an external surface of the container 60. Ideally the container 60 is somewhat transparent so that a user may be able to determine if the container 60 is filled with water. A hose 68 may be extended between the drainage pipe 22 and the receiving 62 or the drainage and receiving pipes may have a length to enable a direct connection between the two.

In use, snow blown into the housing 12 melts as it comes in contact with the plates 26 such that water from the snow is collected in the container 60. The screen 52 prevents foreign material from entering the housing 12 so that flow through the drainage pipe 22 is not hindered. When the container 60 or housing 12 fills with water, the water may be drained.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow melting device for removably mounting to a snow blower, the snow blower having a movable thrower for directing direction of snow being thrown, the snow blower having a power supply, said device comprising:

a housing having a bottom wall and a peripheral wall extending upwardly from said bottom wall, said peripheral wall having an upper edge defining an opening extending into said housing, said housing being mountable on the snow blower;

a drainage pipe being fluidly coupled to said housing and being positioned generally adjacent to said bottom wall, a valve being in communication with said drainage pipe for selectively opening and closing said drainage pipe;

a plurality of plates being mounted in said housing, each of said plates having an upper side and a lower side with respect to said bottom wall of said housing;

a plurality of heating elements being mounted in said housing, each of said heating elements being positioned adjacent to one of said lower sides of said plates such that a plurality of heating elements is adjacent to each of the plates, said heating elements each being operationally coupled to the power supply.

2. The snow melting device as in claim 1, wherein each of said plates is angled with respect to said bottom wall at an angle generally between 30 degrees and 60 degrees.

3. The snow melting device as in claim 1, further including an actuator being operationally coupled to said heating elements for selectively turning said heating elements on or off.

4. The snow melting device as in claim 1, further including a hood being attached to said upper edge of said peripheral wall, said hood having an open vertical face, an arcuate upper wall extending from a top side of said vertical face to said peripheral wall, and a pair of side walls, wherein the thrower may be aimed toward said hood.

5. The snow melting device as in claim 4, further including a screen being attached to said upper edge of said peripheral wall and generally extending over said opening in said housing.

6. The snow melting device as in claim 1, further including a screen being attached to said upper edge of said peripheral wall and generally extending over said opening in said housing.

7. The snow melting device as in claim 1, further including a container having a receiving pipe thereon in communication with said drainage pipe, said container being removably mountable to the snow blower.

8. The snow melting device as in claim 7, further including a valve being fluidly coupled to said receiving pipe for selectively opening and closing said receiving pipe.

9. The snow melting device as in claim 8, further including a handle being mounted on an external surface of said container.

10. The snow melting device as in claim 1, further including said container comprising a generally transparent material.

11. A snow melting device for removably mounting to a snow blower, the snow blower having a movable thrower for directing direction of snow being thrown, the snowblower having a power supply, said device comprising:

a housing having a bottom wall and a peripheral wall extending upwardly from said bottom wall, said peripheral wall having an upper edge defining an opening extending into said housing, said bottom wall having a generally rectangular shape, said housing being mountable on the snow blower;

a drainage pipe being fluidly coupled to said housing and being positioned generally adjacent to said bottom wall, a valve being in communication with said drainage pipe for selectively opening and closing said drainage pipe;

a plurality of plates being mounted in said housing, each of said plates having an upper side and a lower side with respect to said bottom wall of said housing, each of said plates being angled with respect to said bottom wall at an angle generally between 30 degrees and 60 degrees;

a plurality of heating elements being mounted in said housing, each of said heating elements being positioned adjacent to one of said lower sides of said plates such that a plurality of heating elements is adjacent to each of the plates, said heating elements each being operationally coupled to the power supply, an actuator being operationally coupled to said heating elements for selectively turning said heating elements on or off;

a hood being attached to said upper edge of said peripheral wall, said hood having an open vertical face, an arcuate upper wall extending from a top side of said vertical face to said peripheral wall, and a pair of side walls, wherein the thrower may be aimed toward said hood;

a screen being attached to said upper edge of said peripheral wall and generally extending over said opening in said housing; and a container having a receiving pipe thereon in communication with said drainage pipe, said container being removably mountable to the snow blower, a valve being fluidly coupled to said receiving pipe for selectively opening and closing said receiving pipe, a handle being mounted on an external surface of said container, wherein snow blown into said housing may melt such that water from said snow is collected in said container.

* * * * *